United States Patent [19]

Chermoni

[11] 4,422,312

[45] Dec. 27, 1983

[54] LOCK ASSEMBLY

[76] Inventor: Israel Chermoni, 20 Shoham, Haifa, Israel

[21] Appl. No.: 213,898

[22] Filed: Dec. 8, 1980

[51] Int. Cl.[3] ..... E05B 15/10; E05B 15/14; E05B 37/12; E05B 65/06

[52] U.S. Cl. ..... 70/133; 70/219; 70/288; 70/312; 70/328; 292/359; 200/61.64; 70/DIG. 49

[58] Field of Search ..... 70/133, 219, 149, 472, 70/312, 287–288, 297–298, 304, 326–328, 333 R, 334, DIG. 49, 442; 340/543; 292/359; 200/61.64

[56] References Cited

U.S. PATENT DOCUMENTS

| | | | |
|---|---|---|---|
| 63,133 | 3/1867 | Atwood | 70/312 X |
| 86,908 | 2/1869 | Cole et al. | 70/133 X |
| 536,666 | 4/1895 | Tucker | 70/149 |
| 577,301 | 2/1897 | Heacock | 70/219 X |
| 742,073 | 10/1903 | Schubert | 200/61.64 |
| 1,083,008 | 12/1913 | Fischer | 70/328 X |
| 1,174,061 | 3/1916 | Fite et al. | 70/328 X |
| 1,196,218 | 8/1916 | Drapalik | 70/304 X |
| 1,372,490 | 3/1921 | Dougall | 70/297 |
| 1,627,962 | 5/1927 | Fiebiger | 200/61.64 |
| 1,708,138 | 4/1929 | Hildahl | 200/61.64 |
| 1,968,285 | 7/1934 | Egan | 70/149 X |
| 2,494,575 | 1/1950 | O'Brien | 70/133 X |
| 2,558,619 | 6/1951 | Lehman | 70/298 X |
| 2,874,240 | 2/1959 | Ricks | 70/DIG. 49 X |
| 3,937,503 | 2/1976 | Harris | 70/328 X |
| 4,262,506 | 4/1981 | Töbel | 70/DIG. 49 X |

FOREIGN PATENT DOCUMENTS

| | | | |
|---|---|---|---|
| 237703 | 8/1911 | Fed. Rep. of Germany | 70/304 |
| 421418 | 5/1947 | Italy | 70/287 |

*Primary Examiner*—Robert L. Wolfe
*Assistant Examiner*—Carl F. Pietruszka
*Attorney, Agent, or Firm*—Spensley, Horn, Jubas & Lubitz

[57] ABSTRACT

A lock assembly incorporating an exterior knob assembly which is axially movable into engagement with a latchbolt. The knob assembly includes a shaft having a circumferential groove into which a plurality of locking pins extend. The position of the locking pins is controlled by means of a number of combination knobs, and normally one or more of the locking pins is positioned within the circumferential groove to prevent axial movement of the exterior knob assembly. When the proper combination is chosen, the locking pins will be out of engagement with the groove, thereby allowing the exterior knob assembly to be moved into engagement with the latchbolt. The latch bolt can also be actuated by means of an interior knob assembly. The interior knob assembly is movable into a position which prevents engagement of the exterior knob assembly with the latchbolt despite the fact that the locking pins are all retracted from the circumferential groove. Means are included for controlling the frictional force required to turn the combination knobs to thereby reduce the chance of detection of the combination of the assembly. In addition, electric switches may be included adjacent the eccentric cylinders in order to detect tampering with the device.

6 Claims, 5 Drawing Figures

LOCK ASSEMBLY

BACKGROUND OF THE INVENTION

1. Field of the Invention

This invention relates to an improved lock assembly which incorporates a plurality of individual combination elements and means for detecting tampering with the lock assembly.

2. Description of the Prior Art

Lock assemblies incorporating a plurality of individual combination elements are shown in U.S. Pat. Nos. 1,448,888 to Walters, 1,612,778 to Meepos and 2,558,619 to Lehman. Basically, these systems operate in a manner such that if any one of the combination assemblies is not in proper position, the lock assembly will be maintained in a locked condition. Each of these assemblies operates to prevent relative rotation between two members when in a locked condition. It is one object of the present invention to provide a lock assembly having an improved multiple combination element configuration.

U.S. Pat. No. 942,553 to Hamilton discloses an assembly in which an exterior knob is normally decoupled from the interior knob and lock assembly. The lock assembly includes an axially movable push bar which may be selectively engaged with the exterior knob so as to enable the exterior knob to actuate the lock assembly. It is another object of the present invention to provide an exterior knob assembly which is selectively engageable with an interior lock mechanism.

Further objects of the invention are to provide a means for the detection of tampering with the lock assembly so as to increase the security of the unit, and to include components within the assembly which increase the difficulty of detection of the combination of the lock assembly.

SUMMARY OF THE INVENTION

The present invention is directed to a lock assembly which includes an axially movable exterior knob assembly. The exterior knob assembly includes a gear which is engageable with a gear of a latch bolt when the knob assembly is moved axially inward. The shaft of the knob assembly includes a circumferential groove into which a plurality of locking pins are movable so as to prevent inward axial movement of the knob assembly. The engagement of the locking pins with the circumferential groove is controlled by means of a plurality of eccentrically mounted cylinders, the positions of which are controlled by combination knobs located on the outside of the unit. Rotation of the cylinders causes the locking pins to move into and out of engagement with the circumferential groove. By positioning the cylinders correctly, all of the locking pins will be moved out of engagement with the groove, thereby enabling the knob assembly to be moved so that its gear engages the gear of the latch bolt, thereby enabling operation of the lock assembly by means of the exterior knob.

In order to increase the security of the locking assembly, one or more friction elements may be included to adjust the force necessary to rotate the eccentric clyinders. This friction force may be provided axially to the rear surface of the cylinders or to the cylindrical surface of the cylinders at a location opposite the locking pins. In either case, the application of the frictional force helps to prevent detection of the position of the locking pins, and thus the combination of the assembly, by an intruder. To further increase security, electric switches may be positioned adjacent the cylinders to detect tampering with the combination knobs. Rotation of the cylinders by an intruder will cause the switches to be closed, which in turn will cause activation of an alarm system to which the leads of the switches are connected.

The lock assembly of the present invention also includes an interior knob assembly having a gear which is always engaged with the latch bolt. The interior knob assembly is axially movable from a first to a second position in which it prevents the exterior knob assembly from being moved into engagement with the latch bolt even though all of the locking pins may be retracted from the circumferential groove. By maintaining the interior knob assembly in the second position, actuation of the lock assembly by means of the exterior knob is absolutely prevented.

The latchbolt assembly incorporates a rack and pinion mechanism which enables the degree of extension of the latchbolt to be controlled and also allows the latchbolt to be moved in either direction. The latter feature enables the assembly to be used on either edge of a door without modification.

BRIEF DESCRIPTION OF THE DRAWINGS

A detailed description of the invention will be made with reference to the accompanying drawings wherein.

DESCRIPTION OF THE PREFERRED EMBODIMENT

Figures 1, 2, 3, 4, 5:
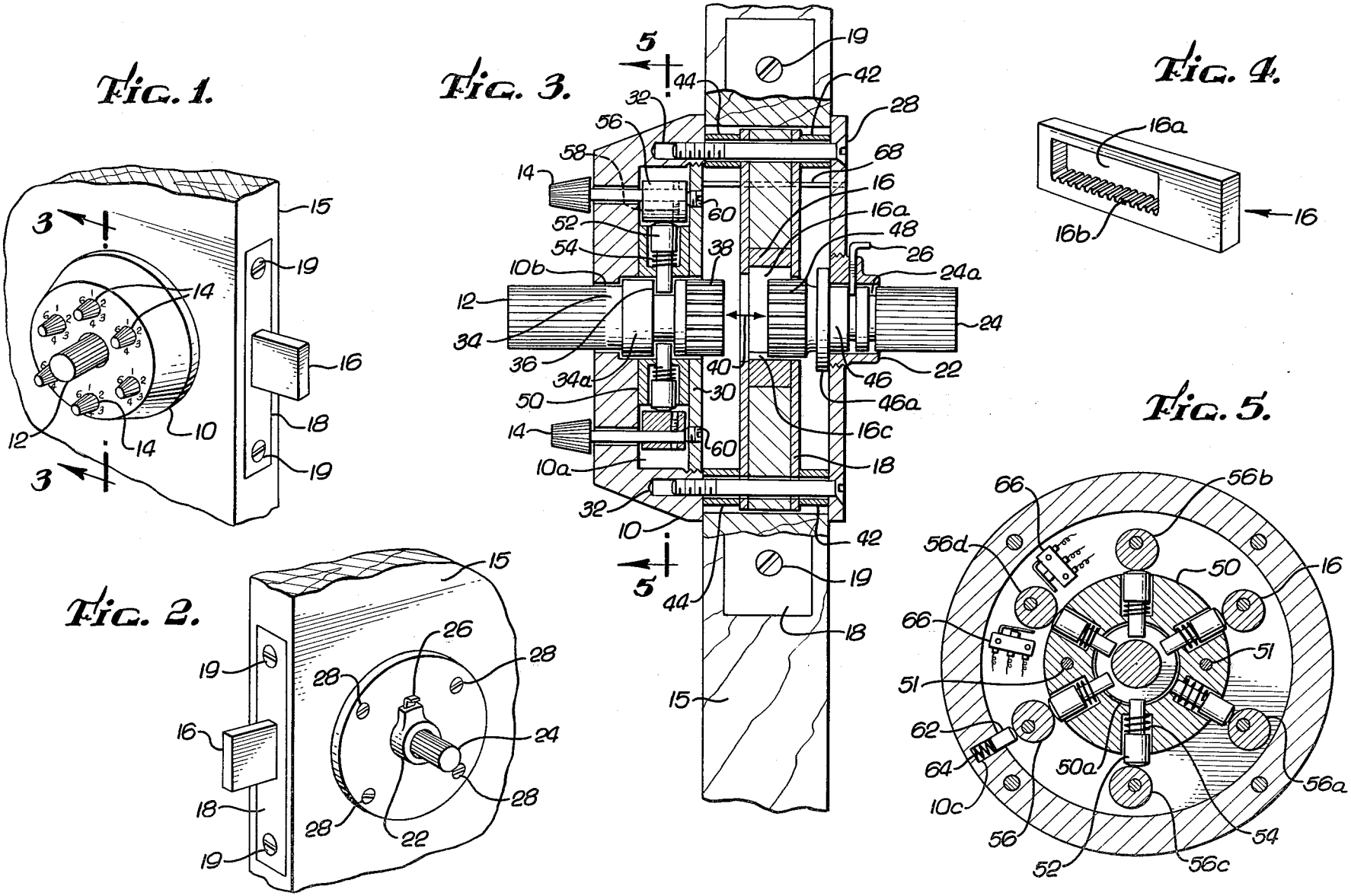
FIG. 1 is a perspective view of the exterior portion of the lock assembly.
FIG. 2 is a perspective view showing the interior portion of the lock assembly.
FIG. 3 is a side view, in section, of the lock assembly.
FIG. 4 is a perspective view of the latch bolt of the lock assembly.
FIG. 5 is a plan view showing the locking mechanism of the invention.

The folldowing detailed description is of the best presently contemplated mode of carrying out the invention. This description is not to be taken in any limiting sense, but is made merely for the purpose of illustrating the general principles of the invention since the scope of the invention is best defined by the appended claims.

Referring to FIGS. 1 and 2, the lock assembly of the present invention includes an exterior cover plate 10 through which passes an exterior bolt actuator knob 12 and a plurality of circumferentially arranged combination lock actuator knobs 14. The lock assembly is shown mounted in a door 15, and a latchbolt 16 extends outwardly from the edge of the door 15. The latchbolt 16 is mounted within a bolt frame 18 which is secured to the door edge by means of screws 19. An interior cover plate 20 is carried on the inside of the door 15. A central hub 22 supports an interior knob 24 and carries a lock retaining pin 26. Four screws 28 pass through openings in the interior cover plate and are coupled to the exterior cover plate 10.

Referring now to FIG. 3, it can be seen that the cover plate 10 has a generally C-shaped cross section and includes an interior space 10*a*. A back plate 30 having a central opening is screwed on to the rear of the front cover plate 10 until its surface is flush with the rear surface of the cover plate 10. The combined cover plate 10 and back plate 30 are held flush against the door surface by the screws 28, which fit into threaded openings 32 in the cover plate 10.

The knob assembly 12 is coupled to a shaft 34 which passes through a central opening 10*b* of the cover plate. The shaft includes an enlarged portion 34*a* which abuts the inner surface of the cover plate 10 and prevents the knob assembly from being removed through the opening 10*b*. The enlarged portion 34*a* includes a circumferential groove 36. A toothed pinion gear 38 is coupled to the shaft 34 by means of a screw connection and extends through the central opening of the back plate 30. The entire exterior knob assembly is axially movable within the opening 10*b* as indicated by arrow 40.

The front to back position of the bolt housing 18 is accurately maintained by means of spacers 42 and 44 located on either side of the housing 18. The bolts 28 pass through the spacers and through openings in the housing 18. The entire lock assembly is therefore held together by means of the bolts 28. As can be seen in FIG. 4, the latchbolt 16 includes a central opening 16*a* having a toothed gear rack 16*b*. The latchbolt 16 is slidable within a central opening in the housing 18. When the exterior knob assembly 12 is moved axially inward, the gear 38 will engage the rack 16*b* and rotation of the exterior knob will effect movement of the latchbolt 16 in one direction or another, depending upon the direction of rotation. It should be noted that the bolt 16 can be moved in either direction, and the assembly therefore can be used at either edge of a door without any modifications. In addition, the degree of extension of the latchbolt 16 is not limited to one fixed value as with most lock assemblies.

The interior knob assembly includes the knob 24, a shaft 46 which passes through the central opening of the hub 22 and a toothed pinion gear 48 connected to the end of the shaft 46. As is the case with the exterior knob assembly, the shaft 46 includes an enlarged portion 46*a* which prevents removal of the interior knob assembly from the unit. The interior knob assembly is axially movable in the direction shown by arrow 40, and is shown in FIG. 3 in its retracted position. In this position, the gear 48 only partially meshes with the rack 16*b*, thereby leaving an open area 16*c* which is free to engage the gear 38. When the interior knob assembly is pushed inwardly and the pin 26 inserted into a groove 24*a* of the interior knob 24, the gear 48 will be in complete engagement with the rack 16*b*. When the interior knob assembly is in this position, it is impossible to move the gear 38 into engagement with the rack 16*b*. In such an instance, the lock assembly is locked to prevent actuation by means of the exterior knob assembly.

Referring now to FIGS. 3 and 5, the lock assembly includes a cylindrical lock pin housing 50 having a central opening 50*a* concentric with the opening 10*b* of the exterior cover plate. The lock pin housing 50 is held in rotational alignment by a pair of posts 51 secured to the cover plate 10 and carries a number of lock pins 52 which are extendable into the circumferential groove 36. The lock pins 52 are biased away from the groove 36 by means of springs 54. Located adjacent each lock pin is a cylinder 56 which is eccentrically attached to the shaft of one of the combination knobs 14. The position of the cylinder 56 on the shaft is adjustable to enable the setting of a combination, and is maintained by means of a set screw 58. Normally, each eccentric cylinder 56 will be in a rotational position somewhere between the position shown for the cylinder 56*b*, in which the corresponding lock pin will be fully inserted into the groove 36, and the cylinder 56*c*, in which the corresponding locking pin will be barely engaged with the groove 36. If any of the locking pins 52 is engaged with the groove 36, axial movement of the exterior knob assembly is prevented. When the combination knobs 14 are moved to their proper positions, all of the eccentric cylinders will be in a position as shown for the cylinder 56*a*, and the locking pins 52 will all be completely disengaged from the groove 36, thereby permitting axial movement of the knob assembly. Assuming that the interior knob assembly is in its retracted position, the gear 38 may then be moved into engagement with the rack 16*b* and rotation of the knob 12 will move the latchbolt 16. However, if the interior knob assembly is in its depressed position, with the pin 26 located in the groove 24*a*, the exterior knob assembly will be prevented from moving into engagement with the rack 16*b*, despite the fact that all of the locking pins 52 are out of the groove 36. Thus, even though one may know the proper combination to the assembly, actuation of the mechanism by means of the outside knob may still be prevented, i.e., the assembly can be positively locked from the inside.

In order to enhance the security of the lock mechanism, a plurality of pressure screws 60 may be included. The pressure screws 60 are screwed through openings in the back plate 30 and abut the rear surfaces of the offset cylinders 56. By tightening the screws 60, the force required to rotate the combination knobs 14 is increased. If no frictional force were provided, an intruder might be able to decode the combination by detecting the variation in force provided by the springs 54 as the eccentric cylinders are rotated. The frictional force provided by the set screws 60 serves to reduce the "feel" of the combination knobs 14 and make it more difficult to determine the position of the eccentric cylinders.

As an alternative or in addition to the use of the set screws 60, the lock assembly may be provided with a plurality of pins 62 as shown in FIG. 5. Each eccentric cylinder would have an associated pin 62 located in an opening 10*c* in the periphery of the cover plate 10. The pin 62 is located diametrically opposite the pin 52 and is forced into contact with the eccentric cylinder by means of a spring 64. The pin 62 provides a force which offsets that provided by the pin 52 and operates to reduce the feel on the knob 14 in a manner similar to the set screws 60. The use of the set screws and/or the pins 62 serves to provide the knobs 14 with a constant rotational force requirement, thereby increasing the difficulty of detection of the combination of the lock assembly.

As a further deterrent to tampering, the assembly may be provided with a number of electrical switches 66. A switch 66 is attached to the interior surface of the cover plate 10 and is located on either side of an eccentric cylinder 56 (for purposes of clarity, only one pair of switches is shown in FIG. 5). The leads of the switches 66 extend through a bore 68 (FIG. 3) and are connected to a burglar alarm, telephone dialer or similar device. When power is applied to the alarm system, the closing of any of the switches 66 will trip the system and cause an alarm to be sounded or telephone to be dialed. The switches are positioned such that they will be activated when the eccentric cylinder 56 is rotated a sufficient extent away from the central position shown for the cylinder 56*d*. Thus, when an intruder attempts to unlock the lock assembly by rotating the knobs 14, one or more switches 66 will be closed and an alarm will be tripped. Electric switches can be included to detect tampering with one or more of the eccentric cylinders 56.

In summary, the present invention is directed to an improved lock assembly including a plurality of eccentric lock cylinders which control the position of spring loaded locking pins with respect to a groove on the shaft of the exterior knob of the assembly. When the proper combination is chosen, all of the locking pins will be out of engagement with the groove, thus enabling the exterior knob assembly to be pushed axially inwardly into engagement with a latchbolt. The interior knob assembly is movable from a first position to a second position which prevents the exterior knob assembly from being engaged with the latchbolt despite the fact that the combination is properly chosen. The assembly may include friction means for reducing the possibility of decoding the combination and may include switch contacts for detecting tampering with the combination knobs.

Although the invention has been described in terms of a single embodiment, it should be recognized that modifications and variations of the invention will readily occur to those skilled in the art. In particular, although the invention has been described with respect to a circular assembly, many different configurations utilizing the locking pin and groove arrangement shown could be developed. Therefore, it is intended that the claims be interpreted to cover all such modifications and variations.

I claim:

1. A lock assembly comprising:

an exterior cover member including an actuation knob shaft opening and a plurality of combination knob shaft openings;

an exterior knob assembly including an exterior knob located to the outside of the cover member, a shaft passing through the actuation knob shaft opening and attached to the exterior knob and a first toothed gear connected to the end of the shaft opposite the exterior knob, said shaft including a groove substantially perpendicular to the axis thereof located to the inside of the cover member, wherein said knob assembly is axially movable within said opening;

a latchbolt housing;

a latchbolt movable within said housing, said latchbolt including a toothed gear surface, wherein said knob assembly is axially movable to enable the toothed gear to be moved into and out of engagement with the gear surface of the latchbolt;

an interior cover member including a hub having an opening therein;

an interior knob assembly including an interior knob, a shaft passing through the hub of the interior cover member and coupled to the interior knob and a second toothed gear attached to the end of the shaft opposite the interior knob, wherein said second toothed gear engages the gear surface of the latchbolt;

locking means for preventing the exterior knob assembly from being axially moved into engagement with the latchbolt, said locking means including a lock pin housing located adjacent the groove of said first shaft, a plurality of lock pins carried within the lock pin housing and movable into and out of engagement with said groove, spring means for biasing each lock pin away from said groove, and a control assembly for each lock pin, each control assembly including a control knob located to the outside of the exterior cover member, a shaft which passes through one of said combination knob shaft openings and is coupled to the control knob and a cylinder eccentrically connected to the shaft, wherein said cylinder is in contact with its associated locking pin and rotation of the cylinder will cause the locking pin to move into and out of engagement with said groove;

wherein said exterior knob assembly can be engaged with the latchbolt only when there is no locking pin located within said groove;

said lock assembly further including friction means, located adjacent each offset cylinder, for applying a frictional force to each cylinder which increases the force required to rotate the cylinder, said friction means aiding in the prevention of detection of the combination of said lock assembly, wherein said friction means includes a rear cover plate coupled to the rear of said front cover plate and carrying a plurality of adjustable set screws, one located adjacent the rear surface of each offset cylinder, each of said set screws being movable into contact with its corresponding offset cylinder so as to provide said frictional force.

2. A lock assembly comprising:

an exterior cover member including an actuation knob shaft opening and a plurality of combination knob shaft openings;

an exterior knob assembly including an exterior knob located to the outside of the cover member, a shaft passing through the actuation knob shaft opening and attached to the exterior knob and a first toothed gear connected to the end of the shaft opposite the exterior knob, said shaft including a groove substantially perpendicular to the axis thereof located to the inside of the cover member, wherein said knob assembly is axially movable within said opening;

a latchbolt housing;

a latchbolt movable within said housing, said latchbolt including a toothed gear surface, wherein said knob assembly is axially movable to enable the toothed gear to be moved into and out of engagement with the gear surface of the latchbolt;

an interior cover member including a hub having an opening therein;

an interior knob assembly including an interior knob, a shaft passing through the hub of the interior cover member and coupled to the interior knob and a second toothed gear attached to the end of the shaft opposite the interior knob, wherein said second toothed gear engages the gear surface of the latchbolt;

locking means for preventing the exterior knob assembly from being axially moved into engagement with the latchbolt, said locking means including a lock pin housing located adjacent the groove of said first shaft, a plurality of lock pins carried within the lock pin housing and movable into and out of engagement with said groove, spring means for biasing each lock pin away from said groove, and a control assembly for each lock pin, each control assembly including a control knob located to the outside of the exterior cover member, a shaft which passes through one of said combination knob shaft openings and is coupled to the control knob and a cylinder eccentrically connected to the shaft, wherein said cylinder is in contact with its associated locking pin and rotation of the cylinder will cause the locking pin to move into and out of engagement with said groove;

wherein said exterior knob assembly can be engaged with the latchbolt only when there is no locking pin located within said groove;

said lock assembly further including bias means located adjacent the circumferential surface of each of said offset cylinders, said bias means providing a force which opposes the force applied to said offset cylinder by said locking pin to thereby increase the difficulty of detection of the combination of said lock assembly.

3. The lock assembly of claim 2 wherein said bias means includes a bias pin located adjacent the surface of each offset cylinder diametrically opposite each locking pin, and spring means for forcing said bias pin into contact with the surface of the offset cylinder.

4. A lock assembly comprising:

a front cover member having a generally C-shaped cross-section and a central lock shaft opening and a plurality of circumferentially located combination shaft openings on the front surface thereof;

a back plate connected to the exterior cover member to define an interior space in the exterior cover member, said back plate including a central opening concentric with the central opening of the cover member and a plurality of circumferentially located set screw openings;

a lock pin housing having a central opening concentric with the central openings of the cover member and back plate, said lock pin housing being located within said interior space;

a knob assembly including an exterior knob located to the outside of the cover plate, a knob shaft extending through the concentric central openings and a first toothed gear connected to the end of the knob shaft opposite the knob, said knob shaft including a circumferential groove;

a plurality of lock pins carried within said lock pin housing, wherein each of the lock pins is movable into and out of the central opening of the lock pin housing and the circumferential groove of the knob shaft;

a plurality of bias springs for biasing the lock pins away from the circumferential groove;

a plurality of combination knobs located on the exterior surface of the cover member, each of said combination knobs including a combination shaft which passes through one of the combination shaft openings;

a plurality of cylinders, one each eccentrically connected to a combination shaft and located adjacent a lock pin, whereby said bias springs force each lock pin into contact with the surface of a cylinder and rotation of the cylinder by means of the corresponding combination knob will cause a lock pin to move into and out of engagement with the circumferential groove;

a plurality of set screws, one each located in a said set screw opening, for applying a friction force to the rear surface of each eccentric cylinder to control the amount of force required to rotate each eccentric cylinder;

a central housing;

a latchbolt movably supported within said central housing, said latchbolt including a toothed gear which is engageable with the first toothed gear;

an interior cover member including a central opening therein;

means for securing the exterior cover member, lock bolt housing and interior cover plate together;

an interior knob assembly including an interior knob, a shaft which passes through the central opening of the interior knob, and a second toothed gear connected to said shaft and engaged with the toothed gear of the latchbolt, wherein said interior knob assembly is axially movable within the central opening of the interior cover plate from a first position in which the first toothed gear can be moved into engagement with the toothed gear of the latchbolt to a second position which prevents the first toothed gear from being moved into engagement with the gear of the latchbolt; and means for maintaining the knob assembly in the second position.

5. The lock assembly of claim 4 further including a plurality of electric switches located within said interior space adjacent said eccentric cylinders, wherein rotation of a cylinder away from a predetermined position will close the contacts of one of the switches, said switches serving to detect tampering with said lock assemblies.

6. The lock assembly of claims 4 or 5 further including:

a plurality of bias pins located within said interior space, one each of said bias pins being positioned adjacent an eccentric cylinder diametrically opposite a locking pin; and a bias spring coupled to each bias pin for forcing the pin into contact with its associated eccentric cylinder, said bias pins providing an offsetting force to that of the locking pins which increases the difficulty of detection of the combination of the lock assembly.

* * * * *